United States Patent [19]

Moragrega

[11] 4,414,989

[45] Nov. 15, 1983

[54] IMPACT FILTER FOR TIPPED CIGARETTES

[76] Inventor: Miguel S. Moragrega, Diagonal 523, 11°, F (Atalaya), Barcelona, Spain

[21] Appl. No.: 306,814

[22] Filed: Sep. 29, 1981

[51] Int. Cl.[3] ..... A24D 1/04; A24D 3/04

[52] U.S. Cl. ..... 131/339; 131/338

[58] Field of Search ..... 131/378, 339, 344, 346, 131/341, 345, 212 R, 212 A

[56] References Cited

U.S. PATENT DOCUMENTS 3,269,394 8/1966 Curtis, Jr. ..... 131/339

3,877,470 4/1975 Jewett et al. ..... 131/212 A

FOREIGN PATENT DOCUMENTS 900370 6/1945 France ..... 131/339

23929 of 1893 United Kingdom ..... 131/212 A

*Primary Examiner*—V. Millin

*Attorney, Agent, or Firm*—Ladas & Parry

[57] ABSTRACT

The invention describes an impact filter for tipped cigarettes comprising a cylindrical chamber of a diameter equal to that of the cigarette and not very high in relation to its diameter, which is provided with a downward tubular orifice in the center of its upper base and has coupled thereto a lower base with very small peripheral orifices, the chamber preferably being located between two conventional portions of absorbent material, which are connected to the chamber by a likewise conventional wrapping to give the resulting assembly the aspect of a normal filter for tipped cigarettes.

1 Claim, 4 Drawing Figures

IMPACT FILTER FOR TIPPED CIGARETTES

The object of this invention is an impact filter for tipped cigarettes, which assists in affording much more effective retention of the noxious ingredients contained in tobacco smoke, preferably tar, an agent which is considered to be highly cancerigenic.

Most filters of tipped cigarettes act by absorption. Said filters are formed by a porous mass which adopts the same diameter as the cigarette and is enveloped by a sheet which, at the same time as it functions as a decorative element, assists in the incorporation of the mentioned filter in the cigarette.

In comparison with the mass presented by such filters, the retention of tar is very low. Attempts have been made to increase the absorption index with the incorporation of particles of activated carbon, which are positioned in the middle of the absorbent mass forming the filter, which is divided into two halves in this specific case, the activated carbon occupying the separation existing between the two. However, the described type of filter is only operated with exclusive rights by a given brand of cigarettes.

In order to break with the inertia of conventional filters and, at the same time, respect the legitimate rights acquired by those who have incorporated activated carbon in the structure thereof, a filter has been invented for cigarettes and without altering the aspect of the latter it improves the retention of tar, acting by impact and not by absorption, as specified for the filters which have been mentioned.

For a better understanding, this specification is accompanied by drawings which, schematically and by way of example only, show a practical case of embodiment of an impact filter for tipped cigarettes meeting the briefly explained conditions.

In said drawings, FIG. 1 shows a perspective view of the filter incorporated in a cigarette, which is represented by dotted lines.

Figure 1:
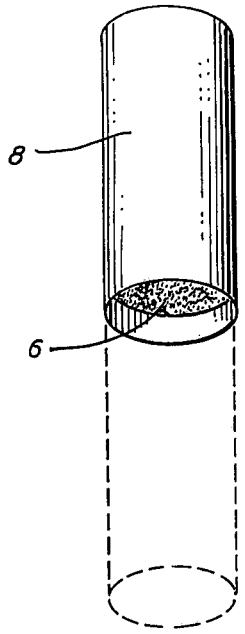
Figure 2:
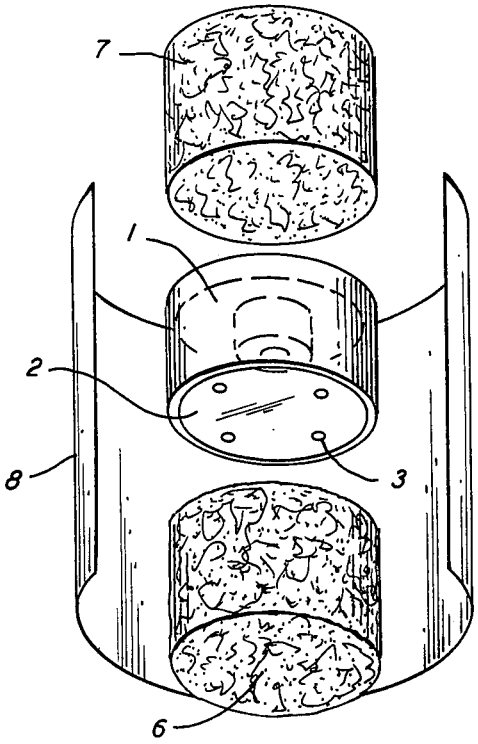
FIG. 2 is an exploded perspective view of the filter, to provide a perfect illustration of all the parts forming it.
Figure 3:
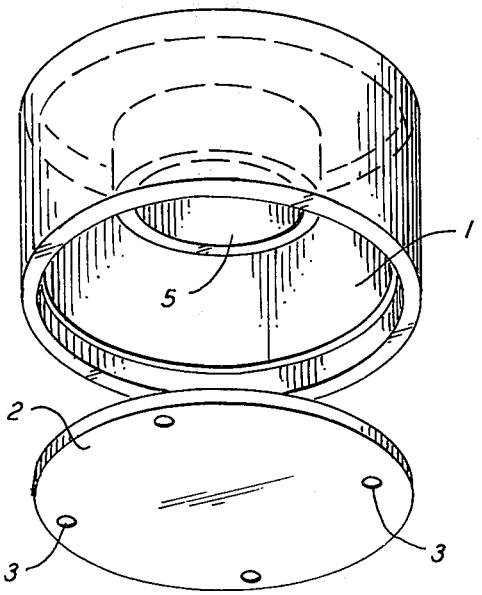
FIG. 3 is likewise an exploded perspective view of the chamber located in the interior of the filter, inside which the impact filtering takes place, thus being the essential feature of the invention.
Figure 4:
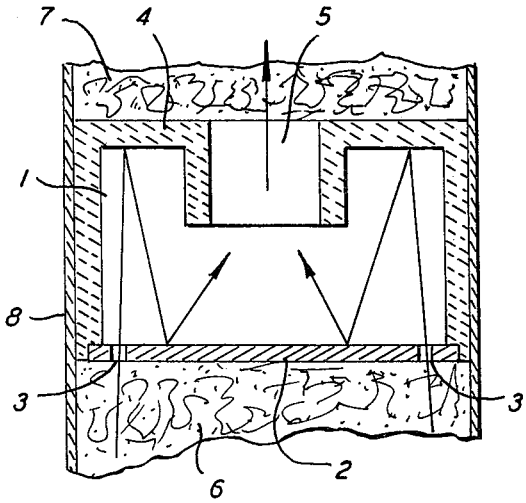

Finally, FIG. 4 is a section of the mentioned chamber incorporated in a cigarette, the trajectory of the smoke which passes through it being indicated with arrows.

On observing said figures it is gathered that the impact filter is essentially formed by a principal member, this being a chamber 1 which adopts a diameter similar to that of the cigarette. The lower base of the mentioned chamber is formed by a coupled plate 2, which has orifices 3 of a very small diameter uniformly distributed over its periphery. Provision has been made in the centre of the upper base 4 of the chamber for a downward tubular orifice 5, the skirt whereof penetrates the inside thereof considerably.

The mentioned chamber can be incorporated in the cigarette accompanied by one or two portions 6 and 7 of absorbent material, the chamber and portions being connected by a wrapping 8, so that the filter presents the conventional aspect of those incorporated by tipped cigarettes commonly available on the market.

Needless to say, the mentioned chamber could be incorporated in the cigarette without the components specified in the preceding paragraph, but it has to be taken into account that it will have to be made of a somewhat hard and, moreover, preferably transparent material, so that the smoker interested therein may check the effectiveness of the retention of tar in the chamber by simply disassembling the unit formed by the filter and releasing the chamber from the portions adjacent thereto.

It has already been indicated that whereas the conventional filters currently incorporated in cigarettes act by absorption, the filter in question here or, specifically, the chamber it incorporates, functions retaining the tar by impact.

As can be seen in FIG. 4, after passing through the absorbent mass 6 located in the first place, the smoke inhaled by the smoker penetrates the chamber 1 through small orifices 3 made on the periphery of the lower base, which is formed by a coupled plate 2. As a result of the position occupied by the mentioned orifices, instead of continuing its upward path and emerging directly through the central tubular orifice 5 provided in the upper base 4 of the chamber, the smoke impinges against the inner surface of the annular portion limited by the downward skirt of the mentioned orifice, being rejected and directed against the inner surface of the lower base of the chamber, proceeding from there to ascend, as a result of the suction to which it is subjected, through the mentioned tubular orifice and pass through the second absorbent portion 7 provided after the chamber.

The impact experienced by the smoke inside the mentioned chamber makes a large portion of the tar which it contains become deposited in film form on the inner contour thereof, but preferably, and forming a considerable mass, on the inner surface of the lower base. Additionally, the adjacent portions 6 and 7 of absorbent material also retain tar, even if in a minimal proportion, as usually occurs, for which reason it can be considered that the role they play in the filter assists and supplements the greater retaining effectiveness of the central chamber which acts by impact, although the filtering portions 6 and 7, above all the one occupying the latter place, have further been provided so that the smoker does not note the hardness of the plastic chamber on putting the cigarette to his lips and, consequently, so that the tact presented by the cigarette does not differ at all from the tipped ones available on the market.

The materials, shapes and sizes, both absolute and relative, of the different components used in the structure thereof and, in general, all aspects not altering, changing or modifying the essence of the invention shall be independent from the object of this invention.

What is claimed:

1. An impact filter for tipped cigarettes, characterized in that it comprises a cylindrical chamber, of somewhat hard and transparent material, the diameter whereof is equal to that of the cigarette, which has coupled thereto a lower base with a series of very small peripheral orifices, their diameters being oriented perpendicularly to the flow of smoke, in order to impart greater velocity to the smoke which passes through them on being inhaled by the smoker and therefore make it impinge with greater force against the inner surface of an upper base of the mentioned chamber, which chamber is not very high in relation to its diameter, so that the mentioned impingement is as intense as possible and the smoke is thus rejected by the impact and directed against the inner surface of the aforementioned lower base, a large portion of the tar contained in the cigarette smoke thus being deposited on both of said bases, the smoke then ascending again, as a result of the suction to which it is subjected, to emerge from the chamber through a downward tubular orifice provided in the centre of the upper base thereof, the chamber being located between two portions of conventional absorbent material, the chamber and portions being connected by a likewise conventional wrapping, so that the specified unit presents the aspect of the filters usually incorporated by tipped cigarettes.

* * * * *